United States Patent [19]

Bugajski et al.

[11] Patent Number: 4,653,733

[45] **Date of Patent: * Mar. 31, 1987**

[54] TUNDISH WITH FLUID FLOW CONTROL STRUCTURE

[75] Inventors: Frank H. Bugajski, South Holland, Ill.; Donald R. Fosnacht, Crown Point, Ind.

[73] Assignee: Inland Steel Company, Chicago, Ill.

[ * ] Notice: The portion of the term of this patent subsequent to May 27, 2003 has been disclaimed.

[21] Appl. No.: 799,286

[22] Filed: Nov. 20, 1985

Related U.S. Application Data

[63] Continuation of Ser. No. 657,368, Oct. 3, 1984, abandoned, which is a continuation-in-part of Ser. No. 640,880, Aug. 15, 1984, abandoned.

[51] Int. Cl.[4] ..... C21B 3/00

[52] U.S. Cl. ..... 266/275; 164/337

[58] Field of Search ..... 266/275, 236, 229, 238, 266/280, 287; 164/489, 337, 335, 437, 438, 281; 222/590, 591, 606, 547, 594

[56] References Cited

U.S. PATENT DOCUMENTS

| | | | |
|---|---|---|---|
| 3,799,410 | 3/1974 | Blossey et al. | 164/281 |
| 3,840,062 | 10/1974 | Kenney | 164/437 |
| 3,887,171 | 6/1975 | Neuhaus | 266/275 |
| 4,042,229 | 8/1977 | Eccleston | 266/275 |
| 4,043,543 | 8/1977 | Courtenay et al. | 266/275 |
| 4,177,855 | 12/1979 | Duchateau et al. | 164/437 |
| 4,997,088 | 12/1976 | Buhrer | 164/337 |

FOREIGN PATENT DOCUMENTS

| | | | |
|---|---|---|---|
| 2166230 | 5/1973 | Fed. Rep. of Germany | 164/337 |
| 57-31452 | 2/1982 | Japan | 266/275 |

*Primary Examiner*—L. Dewayne Rutledge
*Assistant Examiner*—S. Kastler
*Attorney, Agent, or Firm*—Marshall, O'Toole, Gerstein, Murray & Bicknell

[57] ABSTRACT

An elongated tundish for the continuous strand casting of molten metal has a plurality of outlet openings arranged in a row extending in the longitudinal direction of the tundish. There is an elongated dam extending in said longitudinal direction between the row of outlet openings and the location of impact, on the tundish bottom, of a ladle nozzle stream of molten metal. The dam provides uniform residence times in the tundish for molten metal exiting the tundish at inner and outer outlet openings in the row of openings. Fluid flow control structure is located between the dam and the tundish side wall adjacent the row of outlet openings to avoid a dead zone in that region.

14 Claims, 8 Drawing Figures

TUNDISH WITH FLUID FLOW CONTROL STRUCTURE

RELATED APPLICATION

This is a continuation of Ser. No. 657,368 filed Oct. 3, 1984 now abandoned which is a continuation in part of application Ser. No. 640,880 filed Aug. 15, 1984 now abandoned and the disclosure therefore is incorporated herein by reference.

BACKGROUND OF THE INVENTION

The present invention relates generally to apparatus employed in the continuous strand casting of molten metal, such as steel, and more particularly to a tundish which contains structure for controlling the flow of molten metal therein.

In continuous strand casting, molten metal is poured from a ladle into a tundish having a multiplicity of outlet openings from which exit a multiplicity of molten metal strands each directed into a mold through which the strand moves, and the strand is solidified as it moves through the mold. It is desirable that each of the strands exiting from the tundish be of substantially uniform quality and composition with a minimum of inclusion-type impurities. This requires that the molten metal exiting through each of the outlet openings in the tundish be subjected to substantially the same amount of mixing action in the tundish, have essentially the same residence time in the tundish, and be subjected to a sufficient amount of slagging action to remove inclusion impurities from the molten metal to the extent desired.

Inclusion impurities are removed in a tundish by floating a slag cover on top of the molten metal in the tundish and subjecting the molten metal to a period of contact with the slag cover during which the molten metal is not itself undergoing a mixing action. This can be accomplished by providing so-called "plug flow" to the molten metal, as will be explained below in more detail.

A certain amount of mixing action is desirable, before the molten metal undergoes plug flow to the outlet openings, because this contributes to uniformity in the composition of the metal exiting through the various outlet openings in the tundish.

It is also desirable to minimize the locations in a tundish where there are dead zones of molten metal, that is, locations where there is neither a mixing action nor a plug flow. Dead zones are undesirable because the molten metal at those locations undergoes little or no mixing, and dead zones can result in the formation in the tundish of skulls (solidified volumes of metal).

A tundish of the general type which the present invention is intended to improve is elongated and comprises a pair of side walls disposed substantially in the longitudinal direction of the tundish and a pair of opposite end walls each extending in a lateral direction between the side walls. The tundish has a bottom and a substantially open tundish top. The tundish bottom has a plurality of molten metal outlet openings all of which are aligned in a row extending longitudinally between the tundish end walls. In one kind of tundish, there are a pair of inner outlet openings and a pair of outer outlet openings, and all of the openings in the row of outlet openings are generally equally spaced from each other.

Molten metal is directed from a ladle through a ladle nozzle toward the tundish bottom at a ladle nozzle stream impact location laterally spaced from the row of outlet openings and disposed between the end walls at a substantial distance from each end wall, typically midway therebetween. Molten metal impinges against the ladle bottom at that location and flows from there along the ladle bottom to other areas of the tundish.

Molten metal exits as strands from all of the outlet openings in the tundish bottom and passes into the solidification molds. However, in a tundish of the type described above, the quality of molten metal exiting from the inner pair of outlet openings differs from the quality of molten metal exiting from the outer pair of outlet openings, and this is undesirable. In addition, there is a substantial dead zone volume for the molten metal when employing a tundish of the type described above. Another drawback is that the stream quality for the inner strands is poor in that it displays significant "roping", a form of turbulence in the stream. Roping is undesirable because a stream with roping has more surface area exposed to the surrounding atmosphere than a stream without roping, thereby increasing the stream's susceptibility to oxidation and rendering the molten metal "dirtier" which is undesirable.

The defects described in the preceding paragraph are due to the fact that there is a short-circuiting of molten metal to the inner outlet openings and that there is a relatively low volume fraction of plug flow to the inner outlet openings. Plug flow refers to molten metal (or fluid) which flows as a plug from a location where it has undergone mixing to the outlet opening. This is flow as in a pipe. A volume of molten metal undergoing ideal plug flow does not undergo mixing or have turbulence within itself. As a result, inclusions can be removed from that volume of metal into a slag cover atop the bath of molten metal in the tundish. In a volume of molten metal undergoing mixing action within itself, this cannot occur.

Because the plug flow volume to the inner outlet openings is relatively low, both in an absolute sense and in comparison to the plug flow volume to the outer pair of outlet openings, the slagging out of inclusions from molten metal exiting through the inner pair of outlet openings is both less than desirable and less than occurs in the molten metal exiting through the outer pair of outlet openings.

SUMMARY OF THE INVENTION

The drawbacks and defects associated with a tundish of the type described above are greatly reduced or, in some cases, eliminated in a tundish constructed in accordance with the present invention.

In accordance with the present invention, the tundish is provided with an elongated dam extending upwardly from the tundish bottom between the ladle nozzle stream impact location and the row of outlet openings. The dam extends longitudinally between the end walls of the tundish, and the dam has a pair of opposite ends each spaced from a respective end wall of the tundish. The elongated dam substantially equalizes the residence time in the tundish of molten metal exiting through the inner outlet openings with the residence time of the molten metal exiting through the outer outlet openings. The elongated dam prevents short-circuiting of molten metal to the inner outlet openings and increases the residence time in the tundish of molten metal exiting through the inner outlet openings, thereby increasing the floating out of inclusion impurities from the molten metal to a slag layer atop the molten metal in the tundish. The elongated dam also substantially increases the plug flow volume fraction of molten metal exiting the tundish through the inner outlet openings, thereby contributing to the floating out of inclusion impurities.

The parameters of the elongated dam may be controlled in accordance with the present invention to optimize the flow characteristics of the molten metal exiting the tundish through both the inner and outer outlet openings.

Additional flow control structure, associated with the elongated dam, may be provided to reduce the dead zone volume fraction of molten metal in the tundish.

The elongated dam also eliminates roping in the stream of molten metal exiting from the inner outlet openings.

Other features and advantages are inherent in the structure claimed and disclosed or will become apparent to those skilled in the art from the following detailed description in conjunction with the accompanying diagrammatic drawings.

DETAILED DESCRIPTION

Figure 1:
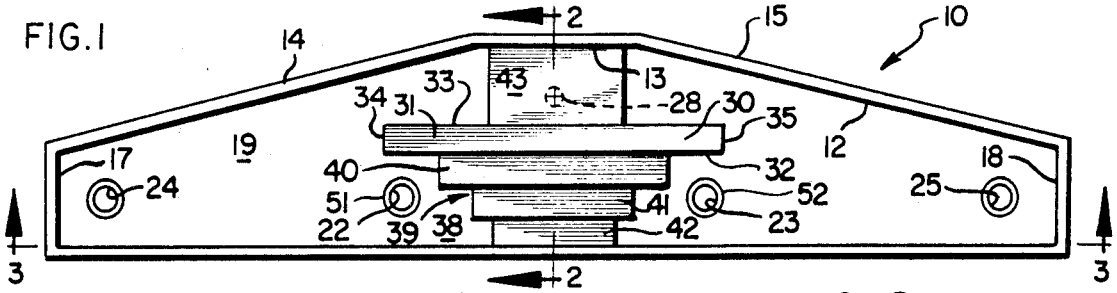
FIG. 1 is a diagrammatic plan view of a tundish with fluid flow control structure in accordance with an embodiment of the present invention.
Figure 2:
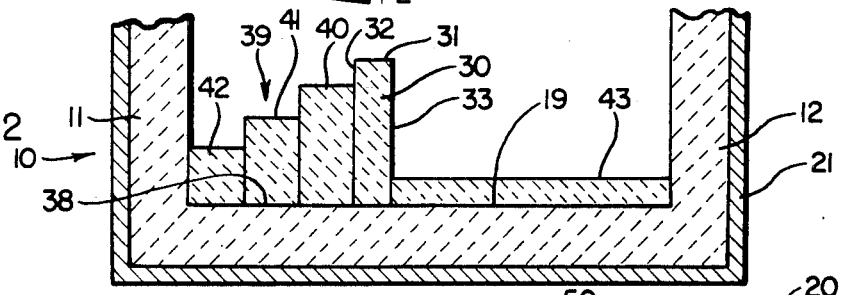
FIG. 2 is an enlarged fragmentary sectional view taken along line 2—2 in FIG. 1.
Figure 3:
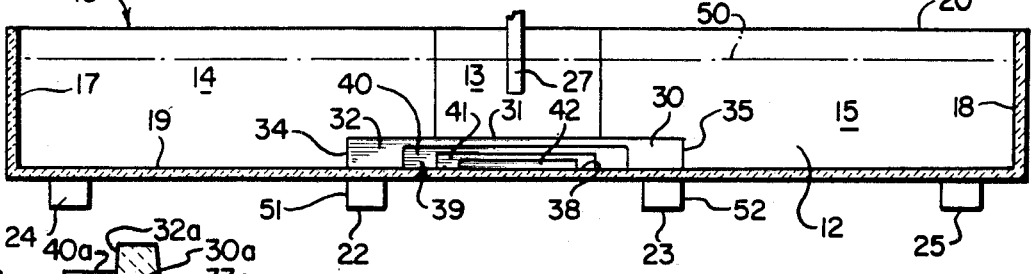
FIG. 3 is a sectional view taken along line 3—3 in FIG. 1.
Figure 2A:
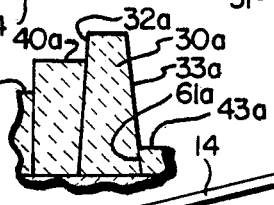
FIG. 2a is a fragmentary sectional view showing a variation of some of the structure shown in FIG. 2.

Referring initially to FIGS. 1-3, indicated generally at 10 is an embodiment of a tundish with fluid flow control structure in accordance with an embodiment of the present invention. Tundish 10 is elongated and comprises a pair of side walls 11, 12 disposed substantially in the longitudinal direction of the tundish and a pair of opposite end walls 17, 18 each extending in a lateral direction between side walls 11, 12.

Side wall 12 comprises a center side wall portion 13 and a pair of end portions 14, 15 converging from tundish end walls 17, 18, respectively, toward center portion 13 of side wall 12. Side wall 12 defines what is essentially a delta-shaped tundish portion.

Tundish 10 also comprises a bottom 19 and an open top 20 (FIG. 3). Tundish bottom 19 has two pairs of molten metal outlet openings, an inner pair 22, 23 and an outer pair 24, 25. All of the outlet openings 22–25 are aligned in a row extending longitudinally between end walls 17, 18. Openings 22–25 all have substantially the same diameter. Illustrated in FIG. 3 at 27 is a nozzle or spout from a ladle for containing molten metal which is directed through spout 27 toward a ladle nozzle stream impact location 28 on tundish bottom 19 (FIG. 1). Impact location 28 is normally laterally spaced from the row of outlet openings 23–25 and is disposed between end walls 17, 18 (or the lateral extension thereof) a substantial distance from each end wall.

An elongated dam 30 extends upwardly from tundish bottom 19 between ladle nozzle stream impact location 28 and the row of outlet openings 23–25. Dam 30 extends longitudinally between end walls 17, 18 and has a pair of opposite ends 34, 35 each spaced from a respective end wall 17, 18. Dam 30 also comprises a top surface 31 and a pair of dam side walls 32, 33 each facing a respective tundish side wall 11, 12.

As shown in FIG. 3, dam 30 extends upwardly from tundish bottom 19 to a height which is substantially uniform from one dam end 34 to the other dam end 35.

All of the tundish walls 11, 12 and 17, 18 extend upwardly from tundish bottom 19 to a predetermined, uniform height. Some examples of the relative dimensions of dam 30 and certain parts of tundish 10 are described below.

Dam 30 extends upwardly from tundish bottom 19 to a maximum height substantially less than one-half the predetermined height of the tundish walls. Preferably the dam's maximum height is about 25–35% of the height of the tundish walls.

Each of the two inner outlet openings 22, 23 is longitudinally spaced from the other and each is located on a respective opposite side of the longitudinal mid-point of tundish 10 at substantially the same distance therefrom as the other inner outlet opening. Dam 30 has a length greater than the distance between the respective center lines of inner outlet openings 22, 23 but substantially less than the distance between the outer pair of outlet openings 24, 25. Preferably, dam 30 has a length not substantially greater than the distance between the longitudinally outermost points 51, 52 on inner outlet openings 22, 23.

The distance, from center to center, between a respective outer outlet opening 24 or 25 and the closest inner outlet opening 22 or 23 is substantially the same as the distance between the pair of inner outlet openings 22, 23. The length of dam 30 is substantially less than 150% of the distance between adjacent openings 24, 22 or 22, 23 or 23, 25. Preferably dam 30 has a length about 120–135% of the distance between the center lines of inner outlet openings 22, 23.

The width of dam 30 is substantially less than the distance between the center line of the dam and the center line of the row of outlet openings 22–25. The row of outlet openings is disposed between dam 30 and side wall 11. The maximum distance, in a lateral direction, between the center line of the row of outlet openings and side wall 11 is less than the maximum distance, in the lateral direction, between the center line of the row of outlet openings and other side wall 12. In the embodiment of FIGS. 1–3, the maximum distance to other side wall 12 would be at center portion 13 of wall 12. The distance between the center line of dam 30 and the center line of the row of outlet openings 22–25 is less than the distance, in a lateral direction, between the center line of the row of outlet openings and side wall 11.

There is a central area 38 on tundish bottom 19 defined substantially by side wall 11 and dam 30 at opposite sides of the area and by inner outlet openings 22, 23 at opposite ends of area 38. Absent flow control structure of the type about to be described, this area will constitute a zone with substantially no flow of molten metal, which is undesirable. Therefore, a substantial portion of central area 38 preferably is occupied by a monolithic flow control structure 39 which extends upwardly from tundish bottom 19, abuts against both dam 30 and side wall 11, and is spaced from each of the inner outlet openings 22, 23. Flow control structure 39 reduces the dead flow volume of molten metal adjacent tundish bottom 19 at area 38. In the embodiment illustrated in FIGS. 1–3, monolithic flow control structure 39 comprises an inner layer 40 adjacent dam 30, an intermediate layer 41 adjacent inner layer 40, and an outer layer 42 adjacent side wall 11.

As noted above, dam 30 has a maximum height substantially less than the height of side wall 11. Monolithic flow control structure 39 has a height which increases progressively from side wall 11 to dam 30, but the maximum height of flow control structure 39 is less than the height of dam 30 anywhere, which also makes it less than the height of dam 30 at any location on dam 30 where structure 39 abuts dam 30. In the embodiment illustrated in FIGS. 1–3, the height of flow control structure 39 increases progressively in a stepped fashion from side wall 11 to dam 30, but the height may also increase progressively along a slope from side wall 11 to dam 30.

Monolithic flow control structure 39 has a dimension, in the longitudinal direction of tundish 10, which increases progressively from side wall 11 to dam 30. In the embodiment illustrated in FIGS. 1–3, the increase in dimension is in discrete stages from outer layer 42 to inner layer 40 but monolithic structure 39 could also have side walls diverging in straight lines from tundish side wall 11 to dam 30.

In another embodiment, central area 38 may be substantially occupied by a monolithic flow control structure having unchanging dimensions in all directions (e.g., a block) rather than progressively changing in height and in the longitudinal direction as does flow control structure 39. Alternatively, the flow control structure at central area 38 may have a constant height with changing dimensions in the longitudinal direction, or vice versa.

Monolithic flow control structure 39 buttresses dam 30 against fluid pressure exerted against side 33 of dam 30 as well as reducing dead zone volume in area 38 of the tundish bottom.

Dam 30 equalizes (a) the residence time in the tundish of molten metal exiting through inner outlet openings 22, 23 with (b) the residence time of molten metal exiting through outer outlet openings 24, 25. This avoids short-circuiting of molten metal to inner outlet openings 22, 23 and the disadvantages associated therewith. Such short-circuiting would occur in a tundish 10 without dam 30. Dam 30 also substantially increases the residence time of molten metal exiting tundish 10 through inner outlet openings 22, 23, compared to a tundish without a dam 30, thereby increasing the floating out of inclusion impurities from the molten metal to a slag layer atop molten metal in tundish 10.

Dam 30 substantially increases the plug flow volume fraction of molten metal exiting tundish 10 through inner outlet openings 22, 23, compared to a tundish without a dam 30, thereby contributing to said floating out of inclusion impurities.

In the embodiment of FIGS. 1–3, located on bottom 19 of tundish 10 is a pouring pad 43 disposed between dam 30 and side wall 12, at center portion 13 thereof. Pouring pad 43 absorbs the impact of the pouring stream issuing from ladle nozzle 27 and prevents wear on tundish bottom 19.

A variation of the embodiment illustrated in FIG. 2 is shown in FIG. **2*a* wherein the dam 30*a* tapers from its bottom toward its top, e.g., a decrease in width of about 25% from dam bottom to dam top. In this embodiment, flow control structure 39 includes an inner layer 40*a* having a beveled surface 60*a* abutting the adjacent sloped surface 32*a* of tapered dam 30*a* to accommodate the taper. Similarly, there is a pouring pad 43*a* having a beveled end 61*a* abutting adjacent sloped surface 33*a* of dam 30*a* to accommodate the taper. The taper on dam 30*a* and the abutting beveled surfaces 60*a* and 61*a* cooperate to form a keying structure which holds dam 30*a*** in place and better prevents it from being floated out of place by the action of molten metal in the tundish.

Figure 4:
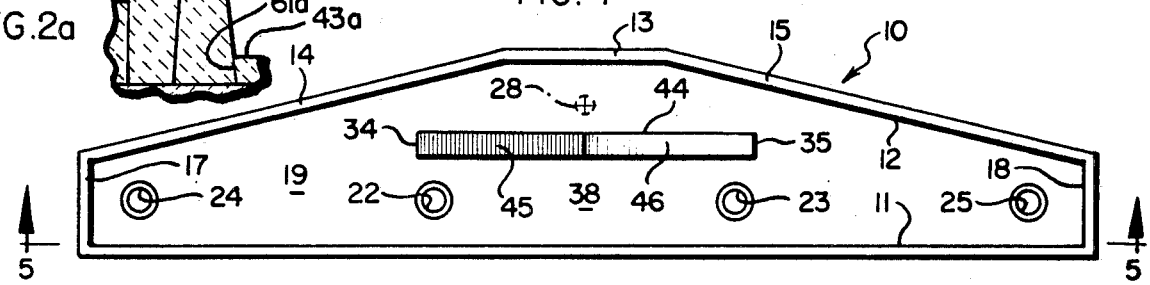
FIG. 4 is a diagrammatic plan view of another embodiment in accordance with the present invention.
Figure 5:
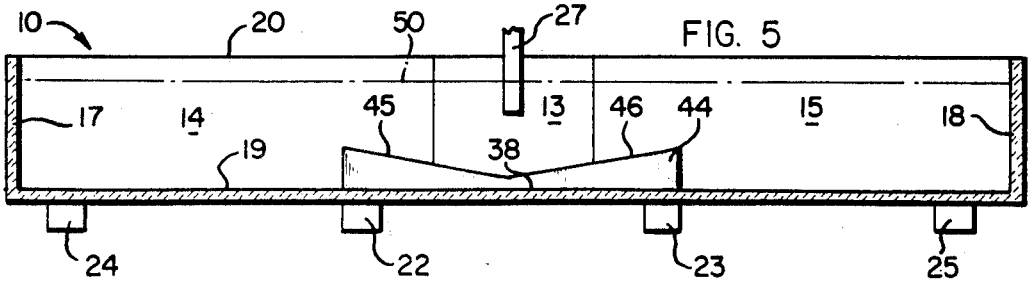
FIG. 5 is a sectional view taken along line 5—5 in FIG. 4.

FIGS. 4–5 illustrate another embodiment in which the tundish is essentially identical to tundish 10 in the embodiment of FIGS. 1–3. The principal difference between the embodiment illustrated in FIGS. 4–5 and that illustrated in FIGS. 1–3 resides in the dam 44 in the embodiment of FIGS. 4–5. Dam 44 has two top surface portions 45, 46 converging toward the center of the dam to define a V-shaped dam. Otherwise, the dam is essentially the same as dam 30 in the embodiment of FIGS. 1–3.

Figure 6:
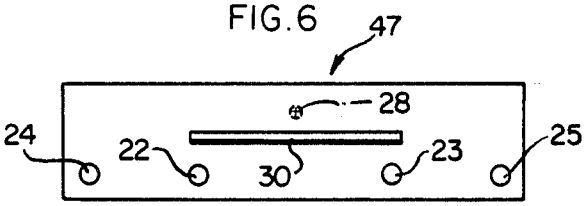
FIG. 6 is a reduced, diagrammatic plan view of a further embodiment in accordance with the present invention.
Figure 7:
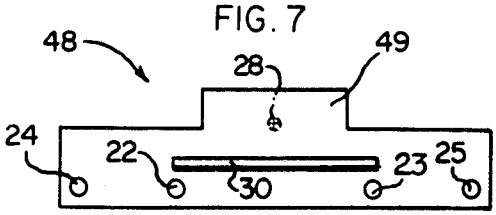
FIG. 7 is a reduced, diagrammatic plan view of still another embodiment in accordance with the present invention.

The embodiments of tundish illustrated in FIGS. 1–3 and FIGS. 4–5 have a so-called delta shape in plan view. Other embodiments of a tundish in accordance with the present invention may employ a rectangular shape in plan view (tundish 47 in FIG. 6) or they may have a T-shape in plan view (tundish 48 in FIG. 7) wherein the ladle nozzle stream impact location 28 is in an appendage 49 constituting a part of tundish 48.

In all of the embodiments, tundish 10, the various dams and the other flow control structure are composed of refractory material. Tundish 10 has an exterior shell 21 (FIG. 2) composed of steel.

Set forth below are tables comparing the fluid flow characteristics of tundishes employing fluid flow control structure in accordance with the present invention and of a tundish without such fluid flow control structure. The data reflected by the Tables were obtained on laboratory-scale models which are approximately one-third the size of a commercial-size tundish employed in commercial steel-making practices. The fluid employed in obtaining the results was water rather than molten steel, but the results obtained would be applicable to molten steel because the kinematic viscosities for (1) water and (2) molten steel are comparable.

Table I reflects data obtained with a tundish 10 having a dam 30 and monolithic flow control structure at tundish central area 38. The data reflected in Table I pertains to an embodiment wherein the monolithic flow control structure in dead zone area 38 differs some from that illustrated at 39 in the embodiments of FIGS. 1–3 in that the monolithic flow control structure reflected by the data in Table I does not have progressively increasing height and width but has a uniform height and a uniform width throughout.

Table II reflects data obtained employing a tundish 10 with elongated dam 30, but without monolithic flow control structure at area 38. Table III reflects data obtained employing the embodiment of FIGS. 4–5 utilizing a dam 44 having a V-shaped top surface and without monolithic flow control structure at central area 38. Table IV reflects data obtained with a tundish 10 employing no dam or other flow control structure.

The approximate dimensions, in millimeters, of the scale model of tundish 10 are the same for all four Tables and are set forth below:

| | |
|---|---|
| Length at side wall 11 | 1900 |
| Width at end walls 17, 18 | 165 |
| Width at center portion 13 of side wall 12 | 357 |
| Height | 254 |
| Length of portions of side wall 12: | |
| center portion 13 | 305 |
| end portions 14, 15 | 813 |
| Distance between adjacent outlet openings 24–22, 22–23 and 23–25 (center to center) | 557 |
| Distance between center of outer outlet opening 24 or 25 and adjacent end wall 17 or 18 | 106 |
| Distance between side wall 11 and center line of row of outlet openings 22–25 | 94 |
| Distance between center portion 13 of side wall 12 and center line of row of outlet openings 22–25 | 263 |
| Distance from center portion 13 of side wall 12 to ladle nozzle impact location | 89 |
| Diameter of outlet openings 22–25 | 9 |

The approximate dimensions, in millimeters, of scale model dam 30 employed in connection with the data obtained in Tables I and II and other relevant dimensions are set forth below:

| | |
|---|---|
| Length of dam 30 | 711 |
| Width of dam 30 | 25 |
| Height of dam 30 | 68 |
| Distance between tundish side wall 11 and dam side wall 32 | 147 |
| Distance between center portion 13 of tundish side wall 12 and dam side wall 33 | 184 |
| Distance between longitudinal center line of dam 30 and the center line of the row of outlet openings | 64 |
| Distance between ladle nozzle impact location 28 and dam side wall 33 | 95 |
| Distance dam end wall 34 or 35 extends past the center of a respective adjacent inner outlet opening 22 or 23 | 76 |

The approximate dimensions, in millimeters, of the scale model monolithic flow control structure at area 38, employed in connection with the data obtained in Table I and other dimensions relevant to the embodiment reflected in Table I are set forth below:

| | |
|---|---|
| Dimension of structure at area 38, in longitudinal direction of tundish 10 | 229 |
| Dimension of structure at area 38, in lateral direction of tundish 10 (between dam side wall 32 and tundish side wall 11) | 147 |
| Height of structure at area 38 | 51 |
| Dimension of pouring pad 43 in longitudinal direction of tundish 10 | 152 |
| Dimension of pouring pad 43 in lateral direction of tundish 10 (between dam side wall 33 and center portion 13 of tundish side wall 12) | 184 |
| Thickness of pouring pad 43 | 13 |

The approximate dimensions, in millimeters, of scale model V-shaped dam 44 employed in connection with the data obtanined in Table III and other relevant dimensions are the same as for dam 30 given above except as set forth below:

| | |
|---|---|
| Height at end walls 34, 35 | 68 |
| Height at center of V | 23 |

Other parameters and conditions relevant to the data reflected by Tables I-IV are set forth below:

| | |
|---|---|
| Liquid level in tundish 10 | 212 mm |
| Fluid flow rate per outlet opening | 14.2 kg/min. |

In the Tables, residence times, in seconds, were determined by adding a dye to the fluid (water) directed into the tundish. Minimum residence (Min. Res.) time indicates the time required for the dye to appear in the tundish exit strands after the injection of dye into the ladle stream from ladle nozzle 27. Peak residence (Peak Res.) time indicates the time when the highest level of color appeared at the tundish exit strands. Both peak and minimum residence times are important in that they share the highest direct correlation with the degree of inclusion float-out in molten steel systems. In the Tables, "submergence depth" indicates the depth to which ladle nozzle 27 extended below the level of the liquid in the tundish, said level being indicated at 50 in FIGS. 3 and 5. "Vol. Frac." is volume fraction.

TABLE I

STRAIGHT LONGITUDINAL DAM WITH BRICKED IN DEAD AREA

| Strands | Min. Res. Time (s) | Peak Res. Time (s) | Mean Res. Time (s) | Plug Flow Vol. Frac. | Mixed Flow Vol. Frac. | Dead Zone Vol. Frac. |
|---|---|---|---|---|---|---|
| Shallow Submergence Depth: 25.4 mm | | | | | | |
| Inner | 21.6 | 79.8 | 323.2 | 0.049 | 0.681 | 0.271 |
| Outer | 19.7 | 53.0 | 320.5 | 0.044 | 0.679 | 0.277 |
| Intermediate Submergence Depth: 63.5 mm | | | | | | |
| Inner | 26.8 | 80.3 | 309.6 | 0.060 | 0.638 | 0.301 |
| Outer | 22.3 | 55.6 | 298.5 | 0.050 | 0.623 | 0.326 |
| Deep Submergence Depth: 101.6 mm | | | | | | |
| Inner | 17.5 | 73.8 | 299.4 | 0.039 | 0.636 | 0.324 |
| Outer | 22.5 | 88.2 | 306.0 | 0.051 | 0.640 | 0.309 |

TABLE II

STRAIGHT LONGITUDINAL DAM ONLY

| Strands | Min. Res. Time (s) | Peak Res. Time (s) | Mean Res. Time (s) | Plug Flow Vol. Frac. | Mixed Flow Vol. Frac. | Dead Zone Vol. Frac. |
|---|---|---|---|---|---|---|
| Shallow Submergence Depth: 25.4 mm | | | | | | |
| Inner | 23.3 | 78.5 | 272.3 | 0.051 | 0.550 | 0.399 |
| Outer | 29.3 | 61.7 | 293.9 | 0.065 | 0.584 | 0.351 |
| Intermediate Submergence Depth: 63.5 mm | | | | | | |
| Inner | 18.5 | 63.7 | 344.8 | 0.041 | 0.720 | 0.239 |
| Outer | 17.4 | 52.7 | 322.2 | 0.038 | 0.673 | 0.289 |
| Deep Submergence Depth: 101.6 mm | | | | | | |
| Inner | 24.2 | 64.2 | 263.2 | 0.053 | 0.528 | 0.419 |
| Outer | 29.9 | 60.3 | 264.2 | 0.066 | 0.517 | 0.417 |

TABLE III

| Strand | Min. Res. Time (s) | Peak Res. Time (s) | Mean Res. Time (s) | Plug Flow Vol. Frac. | Mixed Flow Vol. Frac. | Dead Zone Vol. Frac. |
|---|---|---|---|---|---|---|
| V-SHAPED LONGITUDINAL DAM | | | | | | |
| Shallow Submergence Depth: 25.4 mm | | | | | | |
| Inner | 25.0 | 75.6 | 273.7 | 0.055 | 0.549 | 0.396 |
| Outer | 39.4 | 133.4 | 336.4 | 0.087 | 0.656 | 0.257 |
| Intermediate Submergence depth: 63.5 mm | | | | | | |
| Inner | 18.6 | 72.7 | 278.1 | 0.041 | 0.573 | 0.386 |
| Outer | 31.6 | 141.8 | 337.5 | 0.070 | 0.675 | 0.255 |
| Deep Submergence Depth: 101.6 mm | | | | | | |
| Inner | 22.2 | 48.8 | 290.1 | 0.049 | 0.591 | 0.360 |
| Outer | 35.3 | 87.9 | 335.3 | 0.078 | 0.662 | 0.260 |

TABLE IV

| Strands | Min. Res. Time (s) | Peak Res. Time (s) | Mean Res. Time (s) | Plug Flow Vol. Frac. | Mixed Flow Vol. Frac. | Dead Zone Vol. Frac. |
|---|---|---|---|---|---|---|
| NO FLOW CONTROL DEVICES | | | | | | |
| Shallow Submergence Depth: 25.4 mm | | | | | | |
| Inner | 10.9 | 38.1 | 288.0 | 0.024 | 0.606 | 0.370 |
| Outer | 24.8 | 98.4 | 360.3 | 0.054 | 0.734 | 0.212 |
| Intermediate Submergence Depth: 63.5 mm | | | | | | |
| Inner | 5.5 | 31.1 | 265.9 | 0.012 | 0.570 | 0.418 |
| Outer | 24.1 | 111.2 | 347.0 | 0.053 | 0.706 | 0.241 |
| Deep Submergence Depth: 101.6 mm | | | | | | |
| Inner | 4.7 | 22.0 | 308.2 | 0.010 | 0.664 | 0.326 |
| Outer | 25.0 | 111.0 | 347.5 | 0.055 | 0.706 | 0.240 |

The data in Table IV indicate that, with no flow control structure in the tundish, there is a significant amount of short-circuiting of fluid to the inner strands, as indicated by the minimum residence times for the inner and outer strands. In addition, the peak and mean residence times also show large differences between the inner and outer strands. These differences in flow conditions, if permitted in actual practice, could lead to substantial differences in quality for steel obtained from the inner and outer strands.

There is almost no plug flow volume for the inner strands and a small fraction for the outer strands in Table IV. Plug flow volume is extremely important for inclusion float out. There is significant dead volume for both the inner and outer strands.

Adjustment of nozzle depth causes little difference in flow conditions for the outer strands, but does slightly affect the amount of dead volume obtained for the inner strands in Table IV. In the latter case, the amount of dead volume appears to be highest at intermediate submergence levels.

Referring now to Table III, which relates to the V-shaped longitudinal dam, the use of this flow control device reduces the amount of short circuiting to the inner strands, lowers the difference in residence times between the inner and outer strands, and increases the amount of plug flow volume for the tundish, compared to the case where no flow control devices are used (Table IV). The amount of dead volume obtained is slightly higher than when no control devices are used, and the minimum residence time within the tundish is significantly increased. Overall, these factors should produce better utilization of the entire tundish volume and improved steel quality and consistency from strand to strand.

There appears to be little variation in flow residence times or in plug, mixed, and dead volumes due to changing nozzle submergence in Table III. Stream quality from each strand was quite good with this embodiment.

With regard to Table II (straight longitudinal dam only), the residence time data indicate that this configuration leads to nearly even behavior between the inner and outer strands. The respective minimum, peak, and mean residence times for the inner and outer strands are all very close. Compared to the differences in residence times between inner and outer strands obtained with the V-shaped longitudinal dam (Table III), the results for the straight dam appear to be better. The minimum residence times for the inner strands are much greater than those obtained for the tundish with no flow control devices (see Table IV).

Variation in the nozzle depth had a significant impact on the residence times and volume fractions associated with plug, mixed, and dead zone in Table II. Intermediate submergence of the inlet nozzle leads to the least dead volume, but also decreases the minimum residence time. Shallow or deep submergence tend to give similar residence time and volume fraction results. Overall, the use of this longitudinal dam results in more even behavior between inner and outer strands and in improved residence times and tundish volume utilization compared to the embodiments reflected by Tables III and IV. The even behavior between the inner and outer strands should produce significant metallurgical benefits.

Certain areas of the tundish of Table II are relatively "dead" with respect to flow. This is reflected by the volume fractions shown in Table II, which indicate that in most cases significant dead volume exists for both the inner and outer strands. Dye tracer studies (where dye was placed directly in various regions of the tundish) were conducted to more clearly define the dead areas that exist in the tundish when a straight longitudinal dam is employed. These tests resulted in the identification of central dead zone area 38. In addition the areas adjacent to the very ends of the tundish at 17, 18 are also very slow flow regions.

The residence time and flow volume fractions obtained for the embodiment with a straight longitudinal dam and a bricked-in central dead zone area 38 are reported in Table I. Compared to the embodiment reflected by Table II, the central dead zone area in the front of the tundish (i.e., at 38) is greatly reduced. In fact, the region between the two inner outlet openings 22, 23 is a very active flow zone. The liquid is rapidly swept out of this region of the tundish into the highly turbulent impact zone of the ladle stream. The whole central zone of the tundish is a very well mixed region, ideal for tundish additions.

Some dead volume exists in the tundish near its ends 17, 18, but the total amount of dead volume associated with this configuration of flow control devices (Table I) is generally less than that obtained when just employing the straight longitudinal dam (Table II). In addition, for most cases, it is less than that obtained when no flow control devices are used.

The residence time data in Table I indicate that the flow behavior between the inner and outer strands is very similar for all levels of nozzle submergence.

The use of a straight longitudinal dam with bricked in dead area 38 or similar flow control devices (as at 39 in FIGS. 1-3) appears to give the best overall flow behavior of any of the configurations tested, and produces favorable metallurgical performance for the tundish.

Tests were conducted to determine the effect on the flow behavior in the tundish of using a shorter or longer straight longitudinal dam. In the first case, the dam was lengthened by about 101 mm to a length of 812 mm, and, in the second case, it was shortened by a similar amount to 610 mm. The height and placement of the dams corresponded to that used previously. The results indicate that substantially lengthening or shortening the dam in the embodiment of FIG. 1 does not appear desirable Lengthening the dam leads to more dead volume and shorter overall residence times, and shortening the dam leads to greater differences in flow behavior between the inner and outer strands. In the one-third scale model of the embodiment of FIG. 1, dam 30 is about 711 mm in length and can be in the range of about 669–752 mm, for example.

Tests were also conducted to determine how the flow behavior would be affected if the ladle nozzle stream impact location 28 was varied either towards tundish side wall 12, or towards dam 30. In these tests, impact location 28 was shifted on the scale model either about 38 mm toward the dam or a similar distance toward side wall 12 from the normal location shown in FIG. 1, which is about 89 mm from side wall center portion 13. The results indicate that bringing the ladle stream closer to the dam reduces the dead volume in the tundish, but also increases the difference in residence times between the inner and outer strands. In addition, the volume fraction for plug flow is increased when the inlet stream is shifted toward the dam. Shifting the inlet stream toward the side wall 12 can cause the inlet flow to reach the outer strands before the inner strands.

These results indicate that the placement of the impact location for the ladle stream can affect the flow behavior in the tundish. This effect can be good or bad depending on the conditions existing in the tundish. For example, if it is found that the ends of the tundish are cooler than the central regions, then adjustment of the impact location toward side wall 12 should allow warmer metal to reach the tundish ends, and perhaps, reduce skull buildup in the cool spots. Other operational considerations may warrant placement of the impact location closer to the dam.

Two tests were conducted to determine the qualitative effect of shutting off either an inner or an outer strand. For these tests, the usual fluid level (212 mm) was maintained, and dye was injected after one outlet opening was plugged. The whole tundish volume remains very active when an inner outlet opening 22 or 23 is plugged. In contrast, when an outer outlet opening 24 or 25 is plugged, the region around the plugged opening is essentially dead to fluid flow. Such behavior will likely lead to skull formation in this dead zone of the tundish. Therefore, it is more desirable to plug an inner opening than an outer opening.

The foregoing detailed description has been given for clearness of understanding only, and no unnecessary limitations should be understood therefrom, as modifications will be obvious to those skilled in the art.

We claim:

1. An elongated tundish for the continuous strand casting of molten metal, said tundish comprising:

A pair of side walls disposed substantially in the longitudinal direction of said tundish and a pair of opposite end walls each extending in a lateral direction between said sidewalls;

a tundish bottom and a substantially open tundish top;

said tundish bottom comprising a plurality of inner molten metal outlet openings and an outer pair of outlet openings all of which are aligned in a row extending longitudinally between said end walls;

said tundish bottom having a ladle nozzle stream impact location laterally spaced from said row of outlet openings and disposed between said end walls at a substantial distance from each end wall;

and an elongated dam extending upwardly from said tundish bottom between said ladle nozzle stream impact location and said row of outlet openings;

said dam extending longitudinally between said end walls and having a pair of opposite ends each spaced from a respective end wall.

2. A tundish as recited in claim 1 wherein:

said elongated dam extends upwardly from the tundish bottom to a height which is substantially uniform from one end of the dam to the other.

3. A tundish as recited in claim 1 wherein:

said tundish walls extend upwardly from the tundish bottom to a predetermined height;

and said dam extends upwardly from the tundish bottom to a maximum height substantially less than onehalf said predetermined height of the tundish walls.

4. A tundish as recited in claim 3 wherein:

said dam's maximum height is about 25–35% of said predetermined height of the tundish walls.

5. A tundish as recited in claim 1 wherein:

said inner outlet openings comprise a pair of longitudinally spaced openings each located on a respective opposite side of the longitudinal mid-point of the tundish at substantially the same distance therefrom as the other inner outlet opening;

and said dam has a length greater than the distance between the respective center lines of said inner outlet openings but substantially less than the distance between the outer pair of outlet openings.

6. A tundish as recited in claim 5 wherein:

said dam has a length not substantially greater than the distance between the longitudinally outermost points on said inner outlet openings.

7. A tundish as recited in claim 5 wherein:

the distance between a respective outer outlet opening and the inner outlet opening closest thereto is substantially the same as the distance between said pair of inner outlet openings;

and the length of said dam is substantially less than 150% of the distance between adjacent openings.

8. A tundish as recited in claim 5 wherein:

said dam has a length about 120–135% of the distance between said center lines of said inner outlet openings.

9. A tundish as recited in claim 1 wherein:

the width of said dam is substantially less than the distance between the longitudinal center line of the dam and the center line of said row of outlet openings.

10. A tundish as recited in claim 1 wherein:

said row of outlet openings is disposed between said dam and one of said side walls;

the maximum distance, in a lateral direction, between the center line of said row of outlet openings and said one side wall being less than the maximum distance, in a lateral direction, between the center line of said row of outlet openings and the other side wall.

11. A tundish as recited in claim 10 wherein: the distance between the center line of the dam and the center line of said row of outlet openings is less than the distance, in a lateral direction, between the center line of said row of outlet openings and said one side wall.

12. A tundish as recited in claim 1 and comprising:
means, including the length, width and height of said dam and the spacing of said dam from said row of outlet openings, for substantially equalizing (a) one or more ofthe minimum, peak and mean residence times in said tundish of molten metal exiting through said inner outlet openings with (b) one or more of the minimum, through said outer outlet openings.

13. A tundish as recited in claim 1 and comprising:
means, including the length, width and height of said dam and the spacing of said dam from said row of outlet openings, for substantially increasing the minimum and peak residence times of molten metal exiting said tundish through said inner outlet openings, compared to a tundish without said dam, to increase the floating out of inclusion impurities from said molten metal to a slag layer atop said molten metal in said tundish.

14. A tundish as recited in claim 1 and comprising:
means, including the length, width and height of said dam and the spacing of said dam from said row of outlet openings, for substantially increasing the plug flow volume fraction of molten metal exiting said tundish through said inner outlet openings, compared to a tundish without said dam, to increse the floating out of inclusion impurities from said molten metal to a slag layer atop said molten metal in said tundish.

* * * * *